United States Patent [19]

Wildmann et al.

[11] 4,451,029

[45] May 29, 1984

[54] ARRANGEMENT FOR LATERAL ALIGNMENT OF SHEETS

[75] Inventors: Wolfgang Wildmann, Offenbach am Main; Rudolf Melzer, Hainburg, both of Fed. Rep. of Germany

[73] Assignee: M.A.N. Roland Druckmaschinen Aktiengesellschaft, Fed. Rep. of Germany

[21] Appl. No.: 398,000

[22] Filed: Jul. 14, 1982

[30] Foreign Application Priority Data

Aug. 7, 1981 [DE] Fed. Rep. of Germany ..... 3131279

[51] Int. Cl.[3] ..... B65H 9/04

[52] U.S. Cl. ..... 271/236; 271/108; 271/250

[58] Field of Search ..... 271/98, 108, 231, 236, 271/237, 246, 250, 195

[56] References Cited

U.S. PATENT DOCUMENTS

| | | | |
|---|---|---|---|
| 3,294,396 | 12/1966 | Staines | 271/108 X |
| 3,870,293 | 3/1975 | Simeth | 271/231 |
| 4,130,274 | 12/1978 | Stange | 271/236 |
| 4,260,149 | 4/1981 | Melzer | 271/250 X |

*Primary Examiner*—Richard A. Schacher

*Attorney, Agent, or Firm*—Lyedig, Voit, Osann, Mayer & Holt, Ltd.

[57] ABSTRACT

A device for registering a sheet against a side stop on the feed table of a printing press which includes a suction head flushly recessed in the table and reciprocated for lateral shifting movement, a draft of suction being applied to the head timed with the lateral shifting movement so that the sheet is affirmatively shifted into contact with the side stop. Subsequently, a puff of air is applied to the head timed with the completion of the shifting movement to free the sheet from the head in readiness for removal of the sheet from the table. An auxiliary nozzle recessed in the table in a position adjacent the head is permanently connected to a source of air pressure and arranged approximately parallel to the surface of the table for producing a moving film of air under the sheet in the direction of the side stop to ensure that the sheet remains against the side stop when the suction is no longer effective and until the sheet is removed from the table. The rate of air flow from the auxiliary nozzle and the strength of the puff of air through the head are under the control of respective throttle valves having operating knobs in convenient upwardly facing positions adjacent the suction head.

6 Claims, 6 Drawing Figures

Fig. 3.
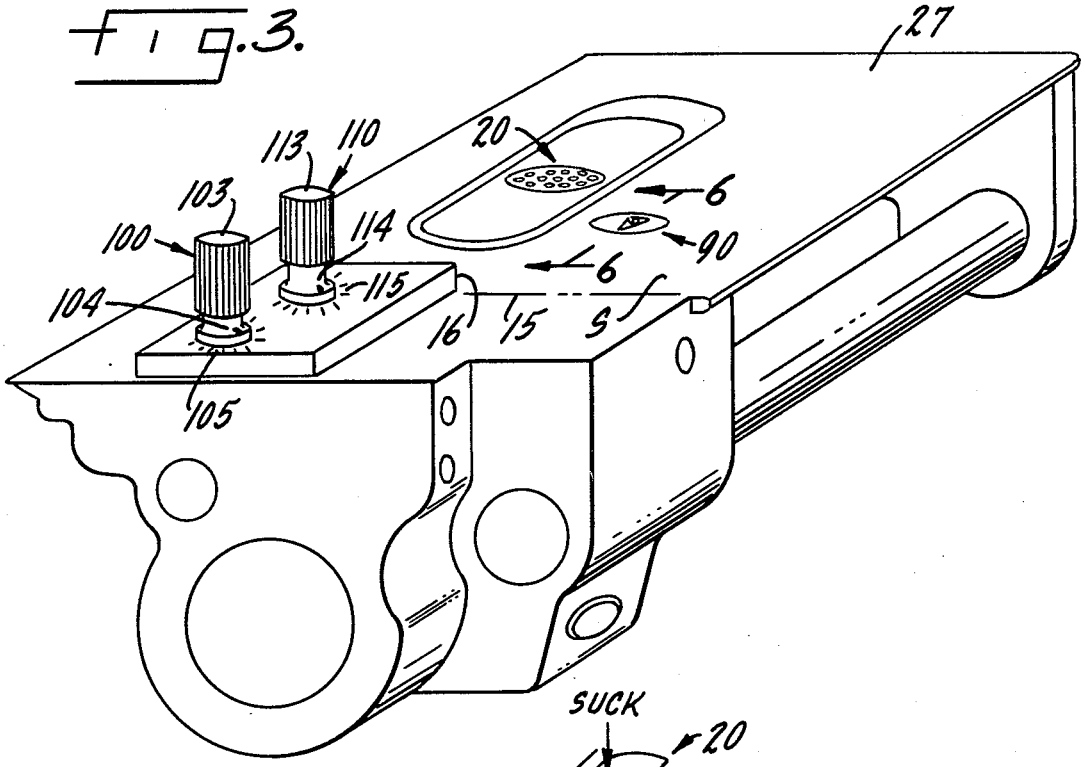
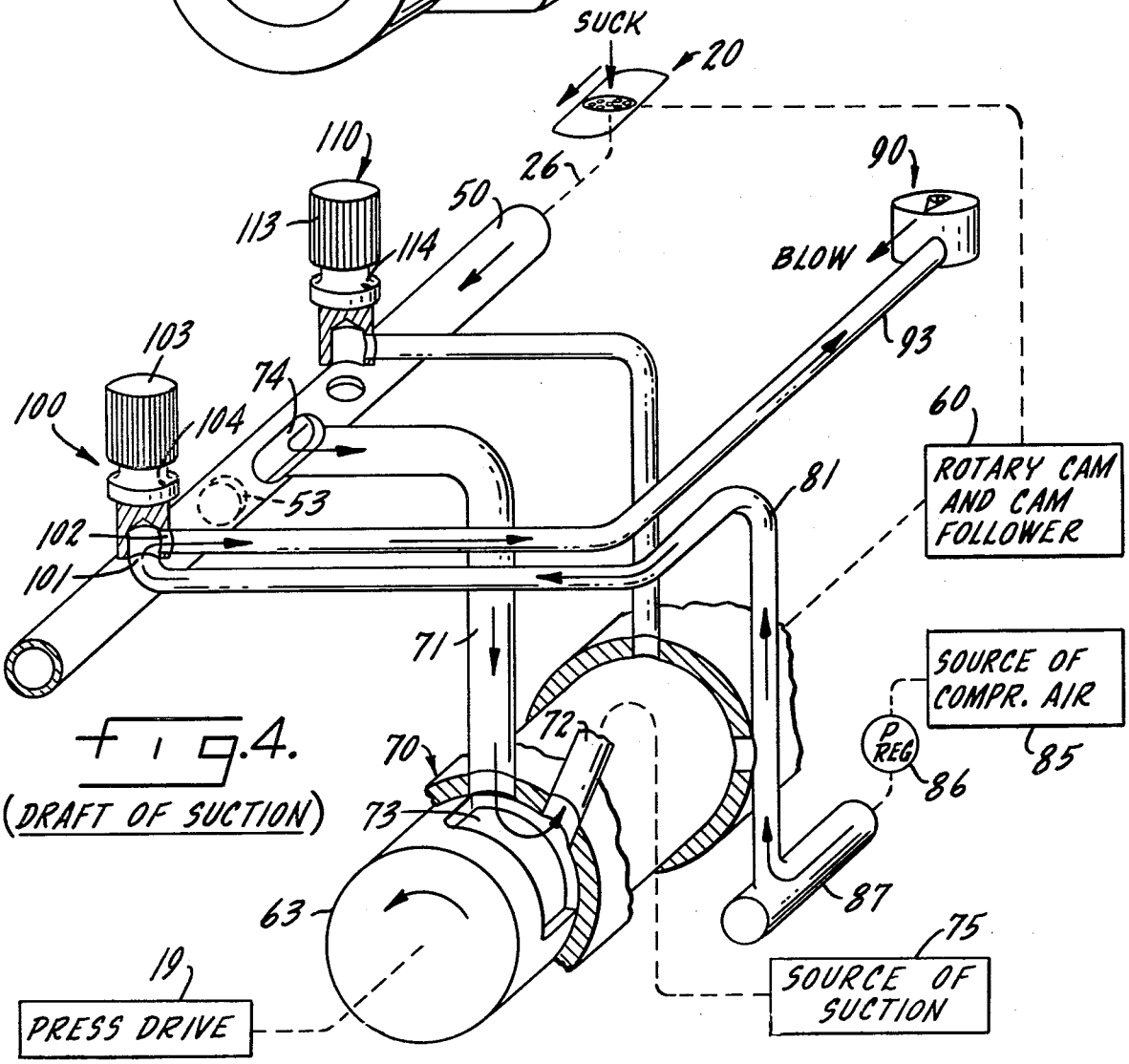
Fig. 4.
(DRAFT OF SUCTION)

(PUFF OF PRESSURE)

ARRANGEMENT FOR LATERAL ALIGNMENT OF SHEETS

In prior U.S. Pat. No. 4,260,149 which issued April 7, 1981 there is shown a feed table for the feeding of sheets one by one into a lithographic printing press, the table having front and side stops so that each sheet is precisely positioned for gripping and conveyance into the press in accurately registered condition. Flushly recessed in the table adjacent the side stop is a reciprocated suction head which is connected to a source of suction which is applied as the head moves in the direction of the side stop timed with the arrival of a sheet. As the head reaches the end of its lateral stroke suction is removed and a short puff of air is supplied to the head to break the vacuum and to free the sheet from the head in readiness for removal of the sheet from the table by a pre-gripper or the like.

It is found in practice that once the suction is switched off there is no assurance that the sheet will stay in precise contact with the side stop. While the time interval between the breaking of the vacuum and the gripping of the leading edge of the sheet by the pre-gripper is extremely short, nevertheless there is an opportunity for a sheet to be dislodged from its aligned condition so that the sheet will be improperly gripped by the pre-gripper and passed through the press in a non-registered condition. It will be understood that in high quality lithographic printing extremely accurate registration is called for in order to achieve an optimum relationship of the differently colored dots of ink which make up a printed reproduction. The problem of maintaining a sheet on the table for pick-up in a precisely registered condition is accentuated by application of the puff of air to the sheet which, especially if applied beyond optimum low level force, may have a dislodging effect. The problem of register is further complicated by the differences in thickness, stiffness and porosity of the sheets which may be printed in successive runs.

It is, accordingly, a general object of the present invention to provide a device for registering a sheet against the front and side stops of a feed table with a high degree of reliability and reproducible accuracy. More specifically, it is an object to provide a device for registering a sheet against a side stop which employs a reciprocated suction head flushly recessed in the surface of the table for applying a short draft of suction immediately followed by a brief puff of air but in which there is no possibility that dislodgement of the sheet may occur between the time that the suction is cut off and the time that the sheet is removed from the table.

It is another object to provide a suction-type device for registering a sheet against a side stop which employs a puff of pressurized air for braking and suction plus a more continuous flow of pressurized air under the sheet with means for quickly and easily optimizing the flow of air for sheets of different thickness, stiffness and degree of porosity and with means for ensuring that the settings are reproducible in a subsequent run.

It is still another object to provide an arrangement for registering a sheet against the front and side stops of a feed table which is simple in construction and operation, which is highly economical, and which may be incorporated in new designs of printing presses as well as presses which are already in the field.

Other objects and advantages of the invention will become apparent upon reading the attached detailed description and upon reference to the drawings in which:

FIG. 3 is a perspective view of the registering assembly;

FIG. 4 is a perspective, largely diagrammatic view showing the suction and compressed air lines and the rotary valves during the suction portion of the cycle;

While the invention has been described in connection with the preferred embodiment, it will be understood that we do not intend to limit the invention to the particular embodiment shown, but intend, on the contrary, to cover the various alternative and equivalent forms of the invention included within the spirit and scope of the appended claims.

Figure 1:
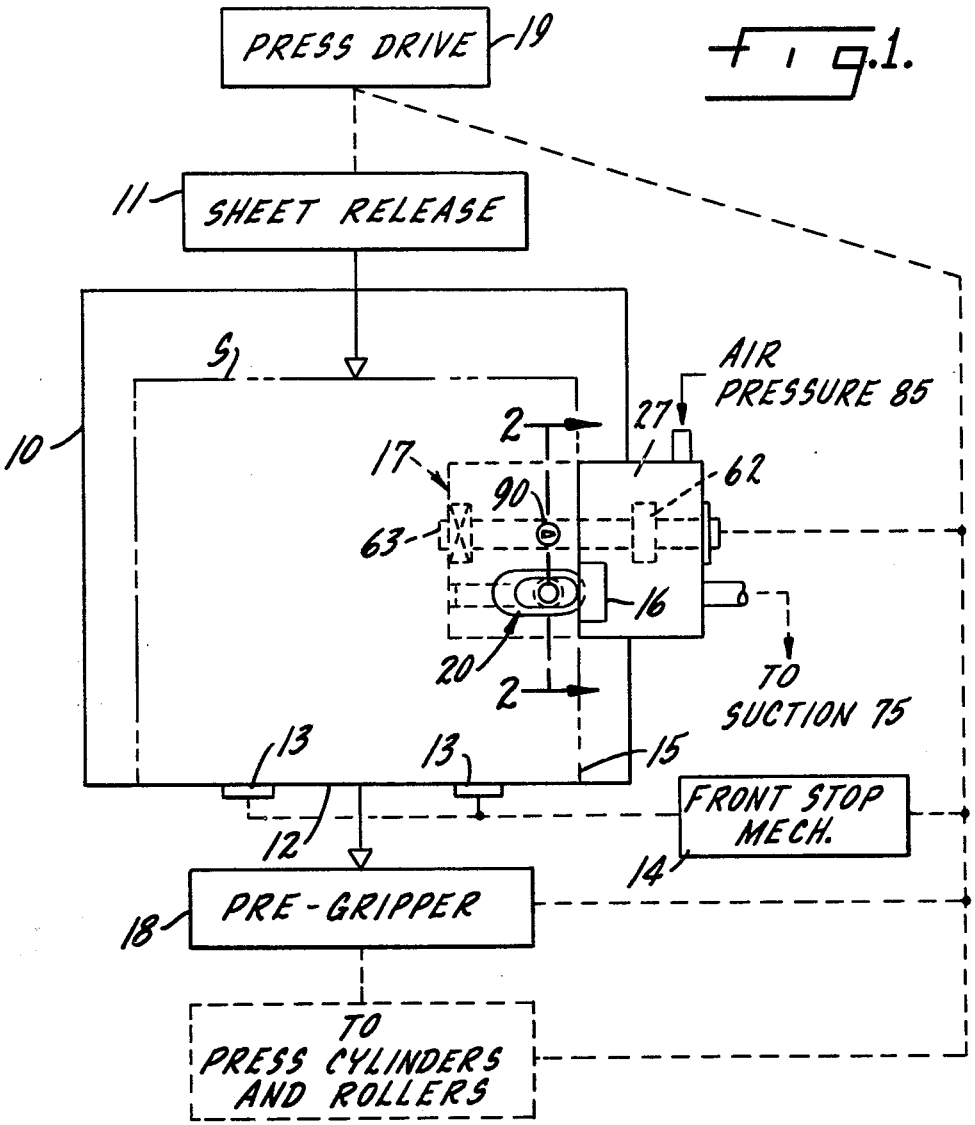
FIG. 1 shows a plan view of a feed table to which the present invention has been applied, with the drive and driven elements being shown diagrammatically.

Turning now to FIG. 1, there is shown, diagrammatically, in plan view, the feed table 10 at the input of a sheet-fed lithographic press unit. A sheet, indicated at S, is released by a sheet depositing, or release, mechanism 11 with forward velocity in the direction of the arrow, the velocity being sufficient so that the leading edge 12 of the sheet carries to a front stop 13 in two portions which are coupled together and which are moved between interposed and retracted positions by a front stop mechanism 14. The sheet follows a path across the table such that the lateral edge 15 of the sheet passes adjacent the side stop 16. Associated with the side stop is a side lay, or side-registering, assembly 17 constructed in accordance with the present invention and which will shortly be described in detail. When the sheet is in registered engagement with the front and side stops it is engaged by a pre-gripper mechanism 18, per se well known to those skilled in the art, which passes the sheet to the impression cylinder of the press unit (not shown) where printing takes place. In order to ensure accurate synchronism of the release, register and gripping operations all of the mechanical elements are directly coupled to the press drive 19. Thus, sheets may be fed across the table, registered, and removed at a high cyclical rate.

Figure 2:
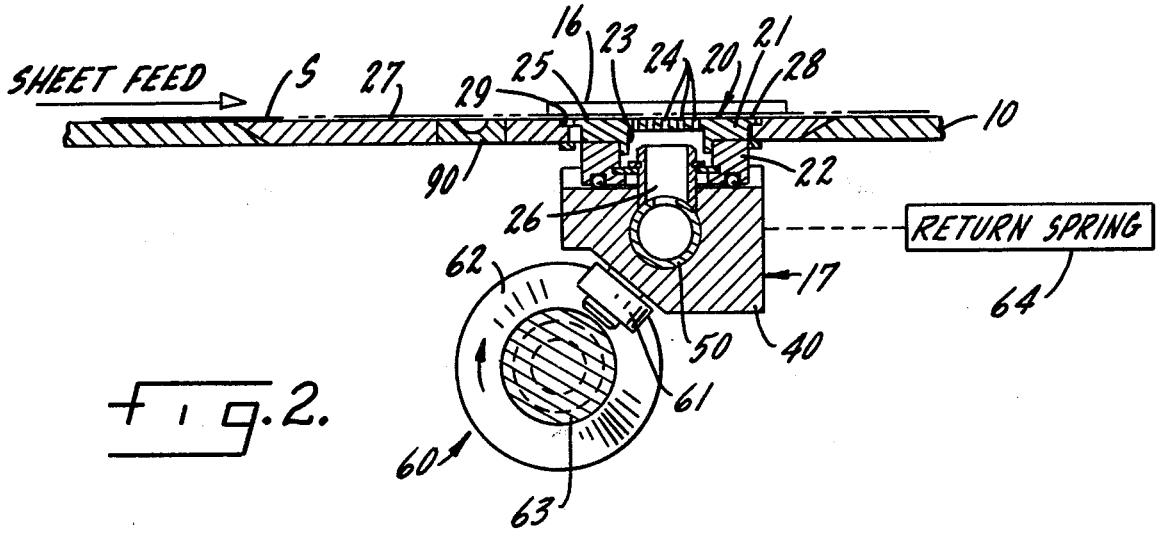
FIG. 2 is a section through of the registering assembly taken along line 2—2 of FIG. 1.

Since the present invention is directed to the air control aspects of a registering assembly, the mechanical details of the structure and driving of the suction head need not be described in detail. For such details, reference may be had to the above-mentioned U.S. Pat. No. 4,260,149, the disclosure of which is included herein by reference. Thus it will suffice to say that the suction head indicated at 20 is in the form of a capsule of generally cylindrical shape having an upper portion 21 and a lower portion 22 fitted together to define a central space 23 (FIG. 2) which communicates with a set of openings 24 in the top surface 25. Suction is applied to the head through a downwardly facing axial opening 26. For mounting the head so that its top surface, which contains the openings, is flush with the surrounding surface 27 of the table, the upper portion 21 of the head is provided with an encircling flange 28 of oval profile and which is seated upon a recess land surface 29.

For the purpose of reciprocating the head 20 in the lateral direction, it is mounted upon a slide 40. For guiding the slide 40 along its path of reciprocation, the slide is telescoped over a hollow suction tube 50 which is stationarily mounted and one end of which is plugged by barrier 53 (see FIG. 4).

For moving the slide 40, and the head 20 which is secured to it, in a direction toward and away from the side stop 16, a reciprocating mechanism 60 is provided which includes a cam follower 61 on the slide cooperating with a face-type rotary cam 62. The cam is mounted upon a shaft 63 coupled to the press drive 19, and the slide 40 is biased by a return spring 64 to maintain the cam follower 61 in its bottomed condition.

In carrying out the invention, suction is applied to the head 20 timed with the lateral movement of the head in the direction of the side stop 16. This is accomplished by rotary suction valve 70 (FIG. 4) having an air inlet line 71 and an air outlet line 72 which communicate via an arcuate passageway 73 formed as a recess in the surface of the shaft 63. The line 71 is coupled to the suction tube 50 via connection 74 while the line 72 leads to a source of suction 75. As a result, a draft of suction is applied to the head 20 during the time that the head is moving toward the side stop 16.

For the purpose of applying a short puff of air through the openings in the head to release the vacuum and free the sheet from the head at the end of the stroke of lateral movement, a rotary pressure valve 80 is provided on the shaft 63 having an inlet line 81 and an outlet line 82 which communicate via an arcuate port 83 formed in the surface of the shaft 63. The outlet line 82 has a connection 84 with the suction tube 50, while the inlet 81 is connected to a source of compressed air 85 via a pressure regulating valve 86 and line 87.

Figure 5:
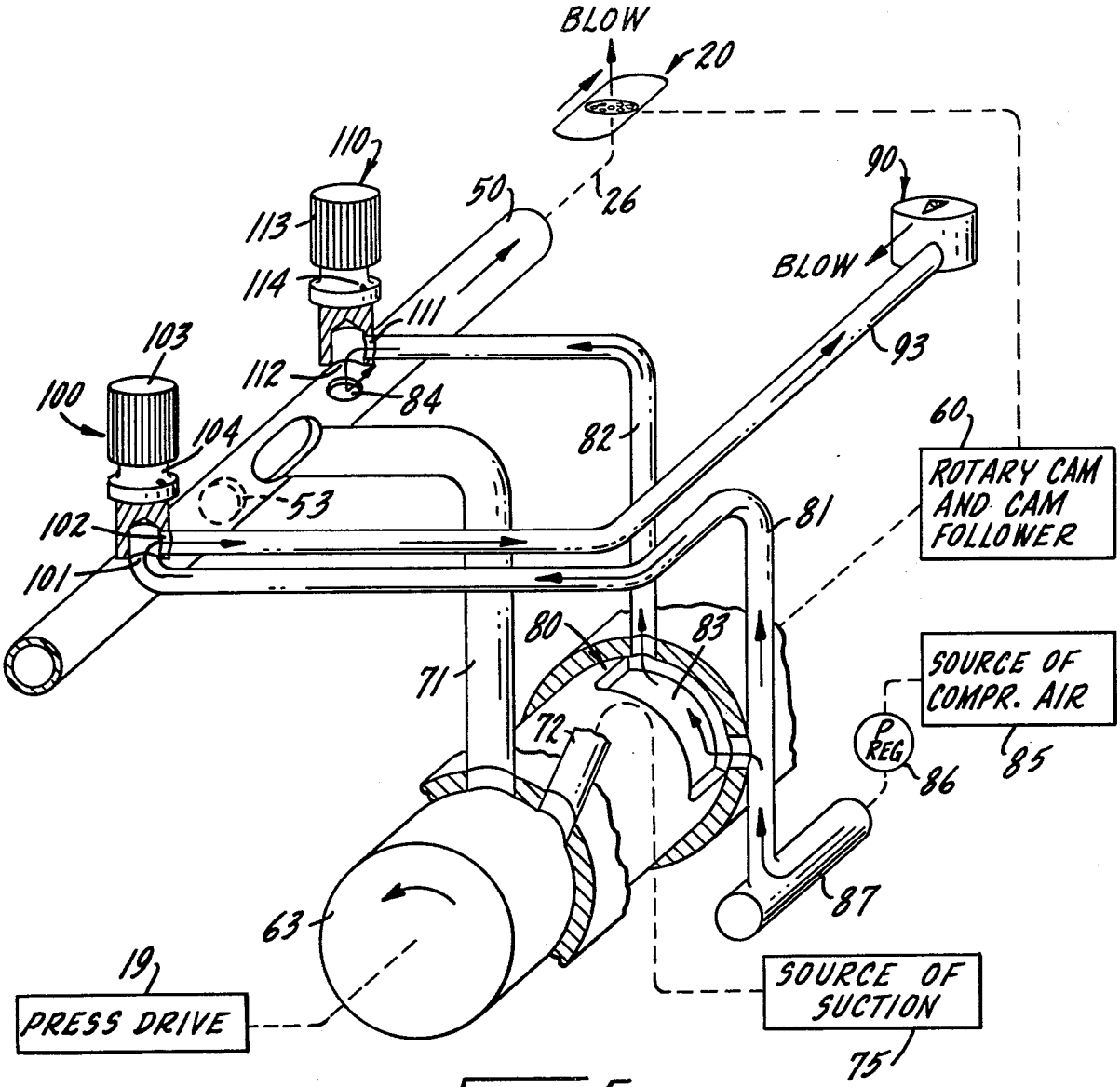
FIG. 5 is a view similar to FIG. 4, but showing the condition of the valves upon applying a puff of air.
Figure 6:
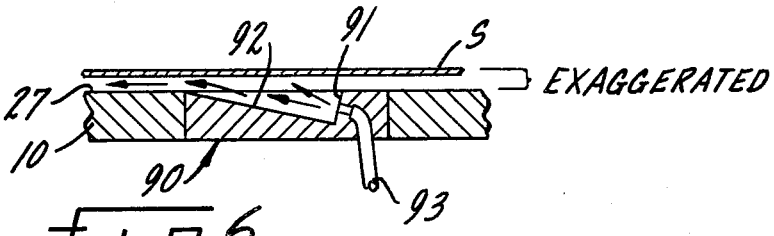
FIG. 6 is a fragmentary section taken through the auxiliary nozzle along line 6—6 in FIG. 3.

In accordance with the present invention, an auxiliary nozzle is recessed in the table in a position adjacent the head, the nozzle being connected to the source of air pressure and directed toward the side stop and approximately parallel to the surface of the table for producing a moving film of air under the sheet in the direction of the side stop to ensure that the sheet remains against the side stop when the suction is no longer effective and until the sheet is removed from the table. Moreover, a first adjustable throttle valve is effectively connected in series with the auxiliary nozzle for reducing the flow of air moving under the sheet in the direction of the side stop to a level sufficient to ensure that the sheet remains against the stop. Thus, we provide a nozzle 90 (FIG. 6) which discharges into a recess of a shallow wedge-shape cross section. The recess is preferably defined by a short more or less vertical wall 91 and a long wall 92 which is angled upwardly at a shallow angle so that air is discharged approximately parallel to the surface of the table, impinging on the underside of the sheet to apply a gentle bias in the direction of the side stop while the sheet remains substantially seated against the surface of the table. The auxiliary nozzle 90 is connected via a line 93 (FIGS. 4 and 5) to a throttle valve 100 having an inlet 101 and an outlet 102, the degree of throttling being set by a control knob 103. The inlet 101 is connected directly to the compressed air line 87 which is under the control of the pressure regulator 86. Preferably the valve knob 103 has an index 104 which cooperates with indicia 105 at the base of the knob (see FIG. 3) so that the throttle settings are reproducible.

Further and in accordance with the invention, a second adjustable throttle valve 110 is effectively connected in series with the rotary valve 80 to control the force of the puff of air which is applied to the head for releasing the vacuum. Such throttle valve has an inlet 111 and an outlet 112 and an upwardly extending knob 113 carrying an index 114 which cooperates with indicia 115 (again see FIG. 3).

In accordance with one of the more detailed features of the invention, both of the operating knobs 103, 113 are faced upwardly with respect to the surface of the table in a conveniently accessible area to one side of the area occupied by the sheet. More specifically, the side stop 16 is in the form of a flat plate which serves as a mount for the operating knobs, the plate carrying the respective indicia 105, 115.

In operation, a sheet S (FIG. 1) is fed across the table by the sheet release mechanism. Timed with the arrival of the sheet at the front stop 13, the suction head moves in the direction of the side stop 16. At the same time the rotary valve 70 is turned on (FIG. 4) so that suction is applied to the head causing the sheet to adhere to the head for affirmative shifting into contact with the side stop. By the term "affirmative" is meant that the suction is sufficiently great to achieve adherence, but the engagement is impositive to permit overtravel of the head beyond the point where the edge of the sheet abuts the stop. Because of the temporary nature of the applied suction, under control of the rotary valve 70, the suction may be referred to as a "draft" analogously to a "puff" of compressed air.

After the sheet is in contact with the side stop, rotation of the shaft 63 causes the valve 70 to close. Opening of the valve 80, connected to the source of pressurized air, causes a puff of air to be transmitted via the throttle valve 110 to the head to break the vacuum and free the sheet. In the preferred form of the invention, the auxiliary nozzle 90 is active during the entire cycle. The air emitted by the nozzle, impinging upon the underside of the sheet (FIG. 6), assists the suction head in movement of the sheet in the direction of the side stop. After the suction has been turned off by the rotary valve 70, the moving film of air from the nozzle 90 continues to apply a gentle bias in the direction of the side stop, thereby maintaining the sheet in contact with the side stop until the sheet is removed, by the pregripper 18, from the table. The bias of the nozzle 90, moreover, ensures that the sheet will remain in registered position and not be dislodged by the puff of air within the head which follows the suction portion of the cycle.

Because of the construction of the auxiliary nozzle 90, which produces discharge of the pressurized air in a direction approximately parallel to the surface of the table, the sheet remains, at all times, substantially seated against the surface of the table. The first throttle valve 100, which services the auxiliary nozzle, is preferably adjusted to produce a level of air flow, and pressure, which is sufficient to achieve the desired level of impingement and resultant bias but which, on the other hand, is not sufficient to blow the sheet away from the table. The optimum pressure, set by the throttle valve 100, depends upon such factors as the thickness, stiffness, porosity and surface finish of the sheet. When the setting of the knob is found which produces the optimum effect for a particular type of sheet, the setting of the index may be noted so that the condition is reproducible for a subsequent run employing the same type of paper.

Similarly, the second throttle valve 110 is adjusted to an optimum condition in which the puff of air applied to the sheet is sufficient to break the vacuum and to achieve prompt separation between the sheet and the head while avoiding an excess discharge which might tend to dislodge the sheet and defeat register. By making use of the index the setting of a second throttle valve is also reproducible. By placing the throttle valves adjacent one another and in upwardly facing position adjacent the side stop, a high degree of convenience is achieved for both the setting and the reading of the indices.

We claim as our invention:

1. In a device for registering a sheet against front and side stops on the feed table of a printing press having a press drive and having means for cyclically feeding sheets across the table toward the front stop, the combination comprising a suction head recessed in the table adjacent the side stop and having a top surface including a set of openings, means mounting the suction head for movement parallel to the surface of the table with the top surface of the head being maintained flush with the surface of the table, reciprocating means coupled to the press drive and timed with the arrival of the sheet at the front stop for shifting the head laterally in the direction of the side stop and for returning it, a source of suction, first valve means coupled to the source of suction for applying a draft of suction to the head timed with the lateral shifting movement so that the sheet is affirmatively shifted into contact with the side stop, a source of substantially constant air pressure, second valve means coupling the head to the source of air pressure for applying a short puff of air to the openings timed with completion of the shifting movement to free the sheet from the head in readiness for removal of the sheet from the table, and an auxiliary nozzle recessed in the table in a position ad3acent the head, said nozzle being permanently connected to the source of air pressure and directed toward the side stop and approximately parallel to the surface of the table for producing a moving film of air under the sheet in the direction of the side stop to insure that the sheet remains against the side stop when the suction is no longer effective and until the sheet is removed from the table.

2. In a device for registering a sheet against front and side stops on the feed table of a printing press having a press drive and having means for cyclically feeding sheets across the table toward the front stop, the combination comprising a suction head recessed in the table adjacent the side stop and having a top surface including a set of openings, means mounting the suction head for movement parallel to the surface of the table with the top surface of the head being maintained flush with the surface of the table, reciprocating means coupled to the press drive and timed with the arrival of the sheet at the front stop for shifting the head laterally in the direction of the side stop and for returning it, a source of suction, first valve means coupled to the source of suction for applying a draft of suction to the head timed with the lateral shifting movement so that the sheet is affirmatively shifted into contact with the side stop, a source of substantially constant air pressure, second valve means coupling the head to the source of air pressure for applying a short puff of air to the openings timed with completion of the shifting movement to free the sheet from the head in readiness for removal of the sheet from the table, an auxiliary nozzle recessed in the table in a position adjacent the head, said nozzle being connected to the source of air pressure and directed toward the side stop and approximately parallel to the surface of the table for producing a moving film of air under the sheet in the direction of the side stop to insure that the sheet remains against the side stop when the suction is no longer effective and until the sheet is removed from the table, a first adjustable throttle valve effectively connected in series with the auxiliary nozzle for reducing the flow of air moving under the sheet in the direction of the side stop to a level sufficient to ensure that the sheet remains against the stop and a second adjustable throttle valve effectively connected in series with the second valve means for reducing the force of the puff of air to a level just sufficient to break the suction and to free the sheet from the head in readiness for removal of the sheet from the table.

3. The combination as claimed in claim 1 in which a first throttle valve is effectively connected in series with the auxiliary nozzle and a second adjustable throttle valve is effectively connected in series with the second valve means, the throttle valves having manual operating knobs which face upwardly with respect to the surface of the table in a conveniently accessible area to one side of the area occupied by the sheet.

4. The combination as claimed in claim 3 in which the side stop is in the form of a flat plate and in which the operating knobs for the throttle valves extend upwardly from the plate, the plate having indicia to facilitate reproducing the optimum settings of the knobs for sheets of predetermined thickness, stiffness and porosity.

5. The combination as claimed in claim 1 or in claim 2 in which the reciprocating means for the head includes a shaft, a rotary cam thereon and a cam follower and in which the first and second valve means are in the form of rotary valves integral with the shaft and offset from one another in phase.

6. The combination as claimed in claim 1 or in claim 2 in which the auxiliary nozzle occupies a recess of shallow wedge-shaped cross section formed of a short wall and an upwardly angled long wall, the nozzle being formed in the short wall so that the air from the nozzle is directed along the long wall of the recess and so that the moving film of air impinges on the underside of the sheet to apply a gentle bias in the direction of the side stop while the sheet remains substantially seated against the surface of the table.

* * * * *